United States Patent [19]

Ampulski et al.

[11] Patent Number: 5,059,282

[45] Date of Patent: Oct. 22, 1991

[54] SOFT TISSUE PAPER

[75] Inventors: Robert S. Ampulski, Fairfield, Ohio; Wolfgang U. Spendel, Cincinnati, Ohio

[73] Assignee: The Procter & Gamble Company, Cincinnati, Ohio

[21] Appl. No.: 484,036

[22] Filed: Feb. 21, 1990

Related U.S. Application Data

[63] Continuation of Ser. No. 206,621, Jun. 14, 1988, abandoned.

[51] Int. Cl.[5] ..... D21H 21/14

[52] U.S. Cl. ..... 162/111; 162/164.4; 162/175; 428/153; 428/446

[58] Field of Search ..... 162/111, 112, 158, 164.4, 162/175; 428/153, 446

[56] References Cited

U.S. PATENT DOCUMENTS

| | | | |
|---|---|---|---|
| 2,826,551 | 3/1958 | Geen | 252/89 |
| 3,301,746 | 4/1964 | Sanford et al. | 162/113 |
| 3,598,622 | 8/1971 | Maher et al. | 162/175 |
| 3,755,220 | 8/1973 | Freimark et al. | 260/17.3 |
| 3,812,000 | 5/1974 | Salvucci, Jr. et al. | 162/111 |
| 3,821,068 | 6/1974 | Shaw | 162/111 |
| 3,844,880 | 10/1974 | Meisel, Jr. et al. | 162/169 |
| 3,964,500 | 6/1976 | Drakoff | 132/7 |
| 3,974,025 | 8/1976 | Ayers | 162/113 |
| 3,994,771 | 11/1976 | Morgan, Jr. et al. | 162/113 |
| 4,011,389 | 3/1977 | Landon et al. | 536/4 |
| 4,158,594 | 6/1968 | Becker et al. | 162/112 |
| 4,191,609 | 3/1980 | Trokhan | 162/113 |
| 4,300,981 | 11/1981 | Carstens | 162/109 |
| 4,364,837 | 12/1982 | Pader | 252/173 |
| 4,440,597 | 4/1984 | Wells | 162/111 |
| 4,441,962 | 4/1984 | Osborn | 162/111 |
| 4,637,859 | 1/1987 | Trokhan | 162/109 |
| 4,950,545 | 8/1990 | Walter et al. | 428/446 |

FOREIGN PATENT DOCUMENTS

| | | | |
|---|---|---|---|
| 899223 | 5/1972 | Canada | 154/72 |
| 0144658 | 6/1985 | European Pat. Off. . | |
| 3420940 | 1/1985 | Fed. Rep. of Germany . | |
| WO82/00485 | 2/1982 | PCT Int'l Appl. | 162/111 |
| 849433 | 9/1960 | United Kingdom . | |

*Primary Examiner*—Steve Alvo

*Attorney, Agent, or Firm*—Thomas J. Slone; Bart S. Hersko; Fredrick H. Braun

[57] ABSTRACT

Tissue paper having a soft, silky, flannel-like tactile feel through incorporation of an effective amount of a chemical additive such as, for example, a polysiloxane. Preferably, less than about 2% of such a chemical additive on a dry fiber weight basis, is incorporated in the tissue paper: more preferably, only about 0.3% or less is so retained. Tissue paper embodiments of the present invention may further comprise a quantity of surfactant material to enhance softness and/or surface smoothness and/or wettability control; and/or a quantity of a binder material such as starch for linting control. For example, embodiments which would otherwise manifest a significant reduction in wettability due to incorporated chemical additives may further comprise sufficient surfactant to at least partially offset the reduction of wettability induced by the chemical additive: e.g., for tiolet tissue embodiments to be sufficiently wettable to be handled in contemporary sewage handling and disposal systems. Additionally, for example, embodiments which would otherwise manifest a significant exacerbation of linting due to such incorporation of chemical additives alone or in combination with surfactant materials, may further comprise an effective amount of a binder such as starch to at least partially offset the linting exacerbation effects of the chemical additive and, if present, surfactant materials.

19 Claims, No Drawings

SOFT TISSUE PAPER

This is continuation of application Ser. No. 206,621, filed on June 14, 1988, now abandoned.

BACKGROUND OF THE INVENTION

1. Field of the Invention

This invention relates, in general, to tissue paper; and, more specifically, to high bulk tissue paper having a soft, silky, flannel-like tactile feel; and enhanced tactile perceivable bulk, and physiological surface smoothness.

2. Background Information

Soft tissue paper is generally preferred for disposable paper towels, and facial and toilet tissues. However, known methods and means for enhancing softness of tissue paper generally adversely affect tensile strength. Tissue paper product design is, therefore, generally, an exercise in balancing softness against tensile strength.

Both mechanical and chemical means have been introduced in the pursuit of making soft tissue paper: tissue paper which is perceived by users, through their tactile sense, to be soft. Such tactile perceivable softness may be characterized by, but not limited to, resilience, flexibility, and smoothness; and subjective descriptors such as feeling like silk or flannel. The present invention pertains to improving the tactile perceivable softness of tissue paper—in particular high bulk, creped tissue paper—through the incorporation of chemical additives: in particular, materials which impart a silky or flannel-like feel to the tissue paper without rendering it greasy or oily to the tactile sense of users of products comprising such tissue paper.

Exemplary such chemical additives are, for example, polysiloxane materials which are simply referred to hereinafter as polysiloxanes. Additionally, surfactant material may be added to further enhance softness and/or surface smoothness and/or to at least partially offset any reduction in wettability caused by the polysiloxane; and binder material such as starch may be added to at least partially offset reductions in strength and or increasing in linting propensity that results from the polysiloxane and, if used, the surfactant additive.

Representative high bulk, creped tissue papers which are quite soft by contemporary standards, and which are susceptible to softness enhancement through the present invention are disclsed in the following U.S. Patents: U.S. Pat. No. 3,301,746 which issued Jan. 31, 1967 to Lawrence H. Sanford and James B. Sisson; U.S. Pat. No. 3,974,025 which issued Aug. 10, 1976 to Peter G. Ayers; U.S. Pat. No. 3,994,771 which issued Nov. 30, 1976 to George Morgan, Jr. and Thomas F. Rich; U.S. Pat. No. 4,191,609 which issued Mar. 4, 1980 to Paul D. Trokhan; and U.S. Pat. No. 4,637,859 which issued Jan. 20, 1987 to Paul D. Trokhan. Each of these papers is characterized by a pattern of dense areas: areas more dense than their respective remainders, such dense areas resulting from being compacted during papermaking as by the crossover knuckles of imprinting carrier fabrics. Other high bulk, soft tissue papers are disclosed in U.S. Pat. No. 4,300,981 which issued Nov. 17, 1981 to Jerry E. Carstens; and U.S. Pat. No. 4,440,597 which issued Apr. 3, 1984 to Edward R. Wells and Thomas A. Hensler. Additionally, achieving high bulk tissue paper through the avoidance of overall compaction prior to final drying is disclosed in U.S. Pat. No. 3,821,068 which issued June 28, 1974 to D. L. Shaw; and avoidance of overall compaction in combination with the use of debonders and elastomeric bonders in the papermaking furnish is disclosed in U.S. Pat. No. 3,812,000 which issued May 21, 1974 to J. L. Salvucci, Jr.

Chemical debonders such as those contemplated by Salvucci, referred to above, and their operative theory are disclosed in such representative U.S. Patents as U.S. Pat. No. 3,755,220 which issued Aug. 28, 1973 to Friemark et al; U.S. Pat. No. 3,844,880 which issued Oct. 29, 1974 to Meisel et al; and U.S. Pat. No. 4,158,594 which issued Jan. 19, 1979 to Becker et al. Other chemical treatments which have been proposed to improve tissue paper include, for example, that disclosed in German Patent 3,420,940, Kenji Hara et al, to wit: to impregnate toilet tissue paper with a combination of a vegetable, animal, or synthetic hydrocarbon oil, and a silicone oil such as dimethylsilicone oil to make it easier to clean and wipe with.

Additionally, a well known mechanical method of increasing tensile strength of paper made from cellulosic pulp is by mechanically refining the pulp prior to papermaking. In general, greater refining results in greater tensile strength. However, consistent with the foregoing discussion of tissue tensile strength and softness, increased mechanical refining of cellulosic pulp negatively impacts tissue paper softness, all other aspects of the papermaking furnish and process being unchanged. However, through the use of the present invention, tensile strength can be increased without negatively impacting softness; or, alternatively, softness can be improved without negatively impacting tensile strength.

SUMMARY OF THE INVENTION

In one aspect of the invention, tissue paper is provided having a basis weight of from about 10 to about 65 g/m$^2$, fiber density of about 0.6 g/cc or less, and which comprises an effective amount of a chemical additive such as, for example, polysiloxane to effect enhanced softness. The tissue paper has a high degree of tactile softness and smoothness; and a silky and/or flannel-like tactile feel. Preferably, the tissue paper comprises from about 0.004 to about 2 percent of such a chemical additive, based on the dry fiber weight of the tissue paper; and, more preferably, the amount of such an additive is from about 0.004 to about 0.3 percent.

Preferred chemical additives for use in accordance with the present invention are polysiloxanes; and preferred polysiloxanes include an amino-functional polydimethylpolysiloxane wherein less than about 10 mole percent of the side chains on the polymer contain an amino-functional group. Directionally, the degree of substitution is indirectly related to the average molecular weight; and, because molecular weights of polysiloxanes are difficult to ascertain, the viscosity of a polysiloxane is used as an objectively ascertainable indicia of molecular weight. Accordingly, for example, about 2% substitution has been found to be very effective for polysiloxanes having a viscosity of about one-hundred-twenty-five (125) centistokes; and viscosities of about five-million (5,000,000) centistokes or more are effective with or without substitution. In addition to such substitution with amino-functional groups, effective substitution may be made with carboxyl, hydroxyl, ether, polyether, aldehyde, ketone, amide, ester, and thiol groups. Of these effective substituent groups, the family of groups comprising amino, carboxyl, and hydroxyl groups are more preferred than the others; and aminofunctional groups are most preferred.

Exemplary commercially available polysiloxanes include DOW 8075 and DOW 200 which are available from Dow Corning; and Silwet 720 and Ucarsil EPS which are available from Union Carbide.

Chemically treated tissue paper of the present invention may further comprise an effective amount of a surfactant to enhance the tactile perceivable surface smoothness of the tissue paper and/or to at least partially offset any reduction of wettability of the tissue paper which would otherwise result from the incorporation of the polysiloxane. Preferably, the amount of surfactant is from about 0.01 to about 2 percent on a dry fiber weight of the tissue paper; and, more preferably, from about 0.05 to about 0.5 percent. Also, preferably, the surfactant is noncationic; and is substantially nonmigratory in situ after the tissue paper has been manufactured in order to substantially obviate post-manufacturing changes in the tissue paper's properties which might otherwise result from the inclusion of surfactant. This may be achieved, for instance, through the use of surfactants having melt temperatures greater than the temperatures commonly encountered during storage, shipping, merchandising, and use of tissue paper product embodiments of the invention: for example, melt temperatures of about 50° C. or higher.

Also, tissue paper comprising a chemical additive in accordance with the present invention may further comprise an effective amount of a binder material such as starch to at least partially offset any reduction of tensile strength or increase in linting propensity which would otherwise result from the incorporation of the S&S modifier and, if present, surfactant material. The effective amount of binder material is preferably from about 0.01 to about 2 percent on a dry fiber weight basis of the tissue paper.

A particularly preferred tissue paper embodiment of the present invention comprises from about 0.004 to about 0.3 percent of a chemical additive such as polysiloxane for imparting a silky, flannel-like tactile feel; from about 0.1 to about 2 percent of surfactant material; and from about 0.1 to about 2 percent of starch, all quantities of these additives being on a dry fiber weight basis of the tissue paper.

DETAILED DESCRIPTION OF THE INVENTION

Briefly, the present invention provides tissue paper having a silky, flannel-like feel, and enhanced tactile perceivable softness through the incorporation of a chemical additive such as, for example, a polysiloxane. Such tissue paper may further include an effective amount of surfactant material and/or a binder material such as starch. Generally speaking, surfactant may be included to enhance tactile perceivable, physiological surface smoothness and/or to assure sufficient wettability for the intended purposes of the tissue paper (e.g., as toilet tissue); and a binder material such as starch may be included to at least partially offset any reduction of tissue paper tensile strength and/or exacerbation of linting propensity which would otherwise be precipitated by the addition of the chemical additive and, if used, the surfactant. Parenthetically, inasmuch as preferred chemical additives are polysiloxanes, the terms "chemical additive" and "polysiloxane" are used somewhat interchangeably hearin albeit it is not intended to thereby limit the scope of the invention to tissue papers comprising polysiloxanes per se, or to limit the term "chemical additive" to polysiloxanes per se.

While not wishing to be bound by a theory of operation or to otherwise limit the present invention, tissue paper embodiments of the present invention are generally characterized as being within a tri-parametric domain defined by empirically determined ranges of the following parameters: first, the ratio of their Total Flexibility to their Total Strength; second, their Physiological Surface Smoothness; and third, their Slip-And-Stick Coefficient of Friction. For example, tests conducted in accordance with the following procedures defined by the present invention's triparametric domain as: a ratio of Total Flexibility to Total Tensile Strength of about 0.13 or less; Physiological Surface Smoothness of about 0.95 or less; and a Slip-and-Stick Coefficient of Friction of about 0.033 or less for pattern densified tissue papers, and about 0.038 or less for tissue paper embodiments having substantially uniform densities. By way of contrast, all contemporary tissue papers which have been tested and which do not embody the present invention fell outside this tri-parametric domain. These parameters and tests are discussed below.

FLEXIBILITY and TOTAL FLEXIBILITY

Flexibility as used herein is defined as the slope of the secant of the graph-curve derived from force vs. stretch % data which secant passes through the origin (zero % stretch, zero force) and through the point on the graph-curve where the force per centimeter of width is 20 grams. For example, for a sample which stretches 10% (i.e., 0.1 cm/cm of length) with 20 grams of force per cm of sample width, the slope of the secant through (0%, 0) and (10%, 20) is 2.0 using the formula:

$$\text{Slope} = \frac{Y_2 - Y_1}{X_2 - X_1}$$

Total Flexibility as used herein means the geometric mean of the machine-direction flexibility and cross-machine-direction flexibility. Mathematically, this is the square root of the product of the machine-direction flexibility and cross-machine-direction flexibility in grams per cm.

TOTAL TENSILE STRENGTH

Total tensile strength as used herein means the geometric mean of the machine and cross-machine breaking strengths in grams per cm of sample width. Mathematically, this is the square root of the product of the machine and cross-machine direction breaking strengths in grams per cm of sample width.

WABY FACTOR

The ratio of Total Flexibility to Total Tensile Strength has been determined to be a factor which characterizes embodiments of the invention as being strong yet having high bulk softness. This ratio is hereby dubbed the WABY Factor.

$$\textit{WABY}\ \text{Factor} = \frac{\text{Total Flexibility}}{\text{Total Tensile Strength}}$$

For instance, a sample having a Total Flexibility of 20 g/cm, and a Total Tensile Strength of 154 g/cm has a WABY Factor of 0.13.

Briefly, tactile perceivable softness of tissue paper is inversely related to its WABY Factor; and limited empirical data indicate that tissue paper embodiments of the present invention have WABY Factors of about 0.13 or less. Also, note that the WABY Factor is dimensionless because both Flexibility and Total Tensile Strength as defined above are in g/cm, their ratio is dimensionless.

PSYSIOLOGICAL SURFACE SMOOTHNESS

Physiological surface smoothness as used herein is a factor (hereinafter the PSS Factor) derived from scanning machine-direction tissue paper samples with a profilometer (described below) having a diamond stylus, the profilometer being installed in a surface test apparatus such as, for example, Surface Tester KES-FB-4 which is available from KATO TECH CO., LTD., Karato-Cho, Nishikiyo, Minami-Ku, Koyota, Japan. In this tester, a sample of tissue is mounted on a motorized drum, and a stylus is gravitationally biased towards the drum at the 12 o'clock position. The drum is rotated to provide a sample velocity of one (1) millimeter per second, and moves the sample 2 cm. with respect to the probe. Thus, the probe scans a 2 cm length of the sample. The profilometer comprises means for counterbalancing the stylus to provide a normal force of 270 mg. Basically, the instrument senses the up and down displacements (in mm) of the stylus as a 2 cm length of sample is scanned under the profilometer probe. The resulting stylus-amplitude vs. stylus-distance-scanned data are digitized, and then converted to a stylus-amplitude vs. frequency spectrum by performing a Fourier Transform using the Proc Spectra standard program available from SAS Institute Inc., Post Office Box 10066, Raleigh, N.C. 27605. This identifies spectral components in the sample's topography; and the frequency spectral data are then adjusted for human tactile responsiveness as quantified and reported by Verrillo (Ronald T. Verrillo, "Effect of Contractor Area on the Vibrotactile Threshold", The Journal of the Accoustical Society of America, 35, 1962 (1963)). However, whereas Verrillo's data are in the time domain (i.e., cycles per second), and physiological surface smoothness is related to finger-to-sample velocity, Verrillo-type data are converted to a spatial domain (i.e., cycles per millimeter) using 65 mm/sec as a standard finger-to-sample velocity factor. Finally, the data are integrated from zero (0) to ten (10) cycles per millimeter. The result is the PSS Factor. Graphically, the PSS Factor is the area under the Verrillo-adjusted frequency (cycles/mm) vs. stylus amplitude curve between zero (0) and ten (10) cycles per millimeter. Preferably, PSS Factors are average values derived from scanning multiple samples (e.g., ten samples), both forward and backward.

The profilometer described above comprises, more specifically, a Gould Surfanalyzer Equipment Controller #21-1330-20428, Probe #21-3100-465, Diamond stylus tip (0.0127 mm radius) #21-0120-00 and stylus tip extender #22-0129-00 all available from Federal Products, Providence, R.I. The profilometer probe assembly is fitted with a counterbalance, and set up as depicted in FIG. 22 of U.S. Pat. No. 4,300,981 (referenced hereinbefore).

SLIP-AND-STICK COEFFICIENT OF FRICTION

Slip-and-stick coefficient of friction (hereinafter S&S COF) is defined as the mean deviation of the coefficient of friction. It is dimensionless. It may be determined using commercially available test apparatus such as, for example, the Kato Surface Tester identified above which has been fitted with a stylus which is configured and disposed to slide on the surface of the sample being scanned: for example, a fritted glass disk. When a sample is scanned as described above, the instrument senses the lateral force on the stylus as the sample is moved thereunder: i.e., scanned. The lateral force is called the frictional force; and the ratio of frictional force to stylus weight is the coefficient of friction, mu. The instrument then solves the following equation to determine S&S COF for each scan of each sample.

$$S\&S\ COF = \frac{1}{X}\int_{o}^{X} |\mu - \mu| dx$$

in which $\mu$ is the ratio of frictional force to probe loading;

$\mu$is the average value of $\mu$; and

X is 2 cm.

Returning now to the Detailed Description of The Invention, the present invention—polysiloxane treated tissue papers having enhanced tactile responsiveness—includes but is not limited to: conventionally felt-pressed tissue paper; pattern densified tissue paper such as exemplified by Sanford-Sisson and its progeny; and high bulk, uncompacted tissue paper such as exemplified by Salvucci. The tissue paper may be of a homogenous or multilayered construction; and tissue paper products made therefrom may be of a single-ply or multi-ply construction. The tissue paper preferably has a basis weight of between about 10 g/m$^2$ and about 65 g/m$^2$, and density of about 0.60 g/cc or less. Preferably, basis weight will be below about 35 g/m$^2$ or less; and density will be about 0.30 g/cc or less. Most preferably, density will be between about 0.08 g/cc and about 0.20 g/cc.

Papermaking Fibers which may be utilized for the present invention include fibers derived from wood pulp. Other cellulosic fibrous pulp fibers, such as cotton linters, bagasse, etc., can be utilized and are intended to be within the scope of this invention. Synthetic fibers, such as rayon, polyethylene and polypropylene fibers, may also be utilized in combination with natural cellulosic fibers. One exemplary polyethylene fiber which may be utilized is Pulpex TM, available from Hercules, Inc. (Wilmington, Del.).

Applicable wood pulps include chemical pulps made by the Kraft, sulfite, and sulfate processes; and mechanical pulps including, for example, groundwood, thermomechanical pulp and chemically modified thermomechanical pulp. Chemical pulps, however, are preferred since they impart a superior tactile perceivable softness to tissue sheets made therefrom. Pulps may be utilized which are derived from both deciduous trees which are sometimes referred to as "hardwood"; and coniferous trees which are sometimes referred to as "softwood".

In addition to papermaking fibers, the papermaking furnish used to make tissue paper structures may have other components or materials added thereto: for example, wet-strength and temporary wet-strength resins.

Suitable polysiloxane materials which are useful as S&S modifiers in accordance with the present invention include polymeric, oligomeric, copolymeric, and other multiple-monomeric siloxane materials As used herein, the term polysiloxane shall include all of such polymeric, oligomeric, copolymeric and other multiple-monomeric siloxane materials. Additionally, the polysiloxane can be either a straight chain, a branched chain or have a cyclic structure.

Preferred polysiloxane materials include those having monomeric siloxane units of the following structure:

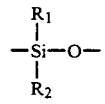

(1)

wherein, $R_1$ and $R_2$ for each siloxane monomeric unit can independently be any alkyl, aryl, alkenyl, alkaryl, aralkyl, cycloalkyl, halogenated hydrocarbon, or other radical. Any of such radicals can be substituted or unsubstituted. $R_1$ and $R_2$ radicals of any particular monomeric unit may differ from the corresponding functionalities of the next adjoining monomeric unit. Additionally, the radicals can be either a straight chain, a branched chain, or have a cyclic structure. The radicals $R_1$ and $R_2$ can, additionally and independently, be other silicone functionalities such as, but not limited to siloxanes, polysiloxanes, and polysilanes. The radicals $R_1$ and $R_2$ can also contain any of a variety of organic functionalities including, for example, alcohol, carboxylic acid, and amine functionalities.

The degree of substitution and the type of substituent have been found to affect the relative degree of soft, silky feeling and hydrophilicity imparted to the tissue paper structure. In general, the degree of soft, silky feeling imparted by the polysiloxane increases as the hydrophilicity of the substituted polysiloxane decreases. Aminofunctional polysiloxanes are especially preferred in the present invention.

Preferred polysiloxanes include straight chain organopolysiloxane materials of the following general formula:

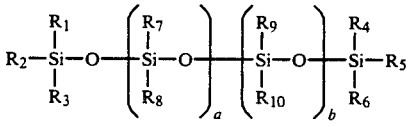

(2)

wherein each $R_1$–$R_9$ radical can independently be any $C_1$–$C_{10}$ unsubstituted alkyl or aryl radical, and $R_{10}$ is any substituted $C_1$–$C_{10}$ alkyl or aryl radical. Preferably each $R_1$–$R_9$ radical is independently any $C_1$–$C_4$ unsubstituted alkyl group. Those skilled in the art will recognize that technically there is no difference whether, for example, $R_9$ or $R_{10}$ is the substituted radical. Preferably the mole ratio of b to (a+b) is between 0 and about 20%, more preferably between 0 and about 10%, and most preferably between about 1% and about 5%.

In one particularly preferred embodiment, $R_1$–$R_9$ are methyl groups and $R_{10}$ is a substituted or unsubstituted alkyl, aryl, or alkenyl group. Such material shall be generally described herein as polydimethylsiloxane which has a particular functionality as may be appropriate in that particular case. Exemplary polydimethylsiloxanes include, for example, polydimethylsiloxane, polydimethylsiloxane having an alkyl hydrocarbon $R_{10}$ radical and polydimethylsiloxane having one or more amino, carboxyl, hydroxyl, ether, polyether, aldehyde, ketone, amide, ester, thiol and/or other $R_{10}$ functionalities including alkyl and alkenyl analogues of such functionalities. For example, an amino functional alkyl group as $R_{10}$ could be an amino-functional or an aminoalkylfunctional polydimethylsiloxane. The exemplary listing of these polydimethylsiloxanes is not meant to thereby exclude others not specifically listed.

Viscosity of polysiloxanes useful for this invention may vary as widely as the viscosity of polysiloxanes in general vary, so long as the polysiloxane is flowable or can be made to be flowable for application to the tissue paper. This includes, but is not limited to, viscosity as low as about 25 centistokes to about 20,000,000 centistokes or even higher. High viscosity polysiloxanes which themselves are resistant to flowing can be effectively deposited upon the tissue paper webs by such methods as, for example, emulsifying the polysiloxane in surfactant or providing the polysiloxane in solution with the aid of a solvent, such as hexane, listed for exemplary purposes only. Particular methods for applying polysiloxanes to tissue paper webs are discussed in more detail below.

Parenthetically, while not wishing to be bound by a theory of operation, it is believed that the tactile-benefit efficacy of the polysiloxane is directly related to its average molecular weight; and that viscosity is directly related to molecular weight. Accordingly, due to the relative difficulty of directly determining molecular weights of polysiloxanes as compared to determining their viscosities, viscosity is used herein as the apparent operative parameter with respect to imparting enhanced tactile response to tissue paper: i.e., softness, silkiness, and flannel-like.

References disclosing polysiloxanes include U.S. Pat. No. 2,826,551, issued Mar. 11, 1958 to Geen; U.S. Pat. No. 3,964,500, issued June 22, 1976 to Drakoff; U.S. Pat. No. 4,364,837, issued Dec. 21, 1982 to Pader; and British Patent 849,433, published Sept. 28, 1960 to Woolston. Also, *Silicon Compounds.* pp. 81–217, distributed by Petrarch Systems, Inc., 1984, contains an extensive listing and description of polysiloxanes in general.

The polysiloxane can be applied to tissue paper as it is being made on a papermaking machine or thereafter: either while it is wet (i.e., prior to final drying) or dry (i.e., after final drying). Preferably, an aqueous mixture containing the polysiloxane is sprayed onto the tissue paper as it courses through the papermaking machine: for example, and not by way of limitation, referring to a papermaking machine of the general configuration disclosed in Sanford-Sisson (referenced hereinbefore), either before the predryer, or after the predryer, or even after the Yankee dryer/creping station although the web is preferably creped after the polysiloxane is applied.

The polysiloxane is preferably applied to the wet web in an aqueous solution, emulsion, or suspension. The polysiloxane can also be applied in a solution containing a suitable, nonaqueous solvent, in which the polysiloxane dissolves or with which the polysiloxane is miscible: for example, hexane. The polysiloxane may be supplied in neat form or, preferably, emulsified with a suitable surfactant emulsifier. Emulsified polysiloxane is preferable for ease of application since a neat polysiloxane aqueous solution must be agitated to inhibit separation into water and polysiloxane phases. The polysiloxane is preferably applied after web formation has been effected. In a typical process, the web is formed and then dewatered prior to polysiloxane application in order to reduce the loss of polysiloxane due to drainage of free water. The polysiloxane is preferably applied to the wet web at a fiber consistency of greater than about 15% in the manufacture of conventionally pressed tissue paper;

and to a wet web having a fiber consistency of between about 20% and about 35% in the manufacture of tissue paper in papermaking machines wherein the newly formed web is transferred from a fine mesh Fourdrinier to a relatively coarse imprinting/carrier fabric. This is because it is preferable to make such transfers at sufficiently low fiber consistencies that the fibers have substantial mobility during the transfer; and it is preferred to apply the polysiloxane after their mobility has substantially dissipated as water removal progresses through the papermaking machine. Also, addition of the polysiloxane at higher fiber consistencies assures greater retention in and on the paper: i.e., less polysiloxane is lost in the water being drained from the web to increase its fiber consistency.

Methods of applying the polysiloxane to the web include spraying and gravure printing Spraying, has been found to be economical, and susceptible to accurate control over quantity and distribution of polysiloxane, so is most preferred. Other methods which are less preferred include deposition of the polysiloxane onto a forming wire or fabric which is then contacted by the tissue web; and incorporation of the polysiloxane into the furnish prior to web formation. Equipment suitable for spraying polysiloxane containing liquids onto wet webs include external mix, air atomizing nozzles such as the 2 mm nozzle available from V.I.B. Systems, Inc., Tucker, Ga. Equipment suitable for printing polysiloxane containing liquids onto wet webs includes rotogravure printers.

The polysiloxane should be applied uniformly to the tissue paper web. A uniform distribution is desirable so that substantially the entire sheet benefits from the tactile effect of polysiloxane. Continuous and patterned distributions are both within the scope of the invention and meet the above criteria.

Polysiloxane can be applied to dry paper webs by the same methods previously discussed with respect to wet paper web polysiloxane treatments.

It has been found, surprisingly, that low levels of polysiloxane applied to tissue paper structures can provide a softened, silky, flannel-like, nongreasy tactile sense of feel without the aid of additional materials such as oils or lotions. Importantly, these benefits can be obtained for many of the embodiments of the present invention in combination with high wettability within the ranges desirable for toilet paper application. Preferably, tissue paper treated with polysiloxane in accordance with the present invention comprises about 2% or less polysiloxane. It is an unexpected benefit of this invention that tissue paper treated with about 2% or less polysiloxane can have imparted thereto substantial softness and silkiness benefits by such a low level of polysiloxane. In general, tissue paper having less than about 0.3% polysiloxane, preferably less than about 0.2%, can provide substantial increases in softness and silkiness and flannel-like quality yet remain sufficiently wettable for use as toilet paper without requiring the addition of surfactant to offset any negative impact on wettability which results from the polysiloxane.

The minimum level of polysiloxane to be retained by the tissue paper is at least an effective level for imparting a tactile difference in softness or silkiness or flannel-like quality to the paper. The minimum effective level may vary depending upon the particular type of sheet, the method of application, the particular type of polysiloxane, and whether the polysiloxane is supplemented by starch, surfactant, or other additives or treatments. Without limiting the range of applicable polysiloxane retention by the tissue paper, preferably at least about 0.004%, more preferably at least about 0.01%, even more preferably at least about 0.05%, and most preferably at least about 0.1% polysiloxane is retained by the tissue paper.

Preferably, a sufficient amount of polysiloxane to impart a tactile sense of softness is disposed in both surfaces of the tissue paper: i.e., disposed on the outwardly facing surfaces of the surface-level fibers. When polysiloxane is applied to one surface of the tissue paper, some of it will, generally, at least partially penetrate to the tissue paper interior. In a preferred embodiment, sufficient polysiloxane to effect a tactile response penetrates through the entire thickness of the tissue paper such that both surfaces have imparted thereto the benefits of polysiloxane. One method found to be useful for facilitating polysiloxane penetration to the opposing surface when the polysiloxane is applied to one surface of a wet tissue paper web is to vacuum dewater the tissue paper from the other surface of the wet tissue paper at the point of application of the polysiloxane.

In addition to treating tissue paper with polysiloxane as described above, it has been found desirable to also treat such tissue paper with surfactant material. This is in addition to any surfactant material that may be present as an emulsifying agent for the polysiloxane.

Tissue paper having in excess of about 0.3% polysiloxane is preferably treated with surfactant when contemplated for uses wherein high wettability is desired. Most preferably, a non-cationic surfactant is applied to the wet tissue paper web, in order to obtain an additional softness benefit, on a constant tensile basis, as previously discussed. The amount of surfactant required to increase hydrophilicity to a desired level will depend upon the type and level of polysiloxane and the type of surfactant. However, as a general guideline, between about 0.01% and about 2% surfactant retained by the tissue paper, preferably between about 0.05 % and about 0.5%, is believed to be sufficient to provide sufficiently high wettability for most applications, including toilet paper, for polysiloxane levels of about 2% or less. However, the benefit of increased wettability is applicable for polysiloxane levels well in excess of 2%, if a sufficient amount of surfactant is incorporated in the tissue paper.

Surfactants which are preferred for use in the present invention are noncationic; and, more preferably, are nonionic. However, cationic surfactants may be used. Noncationic surfactants include anionic, nonionic, amphoteric, and zwitterionic surfactants. Preferably, as stated hereinbefore, the surfactant is substantially nonmigratory in situ after the tissue paper has been manufactured in order to substantially obviate post-manufacturing changes in the tissue paper's properties which might otherwise result from the inclusion of surfactant. This may be achieved, for instance, Through the use of surfactants having melt temperatures greater than the temperatures commonly encountered during storage, shipping, merchandising, and use of tissue paper product embodiments of the invention: for example, melt temperatures of about 50° C. or higher. Also, the surfactant is preferably water-soluble when applied to the wet web.

The level of noncationic surfactant applied to wet tissue paper webs to provide the aforementioned softness/tensile benefit ranges from the minimum effective level needed for imparting such benefit, on a constant tensile basis for the end product, to about two (2) percent: preferably between about 0.01% and about 1% noncationic surfactant retained by the web; more preferably, between about 0.01% and about 0.5%; and, most preferably, between about 0.05% and about 0.3%.

The surfactants preferably have alkyl chains with eight or more carbon atoms. Exemplary anionic surfactants are linear alkyl sulfonates, and alkylbenzene sulfonates. Exemplary nonionic surfactants are alkylglycosides including alkylglycoside esters such as Crodesta TM SL-40 which is available from Croda, Inc. (New York, N.Y.); alkylglycoside ethers as described in U.S. Pat. No. 4,011,389, issued to W. K. Langdon, et al. on Mar. 8, 1977; and alkylpolyethoxylated esters such as Pegosperse TM 200 ML available from Glyco Chemicals, Inc. (Greenwich, Conn.). The above listings of exemplary surfactants are intended to be merely exemplary in nature, and are not meant to limit the scope of the invention.

The surfactant, in addition to any emulsifying surfactant that may be present on the polysiloxane, may be applied by the same methods and apparatuses used to apply polysiloxanes. These methods include spraying and gravure printing. Other methods include application to a forming wire or fabric prior to contact with the web. Any surfactant other than polysiloxane emulsifying surfactant material, is hereinafter referred to as "surfactant," and any surfactant present as the emulsifying component of emulsified polysiloxane is hereinafter referred to as "emulsifying agent".

The surfactant, may be applied to the tissue paper simultaneously with, after, or before the polysiloxane. In a typical process, the surfactant is applied subsequent to formation of the wet web and prior to final drying. Preferably, noncationic surfactants are applied at fiber consistency levels of between about 10% and about 75%; and, more preferably, between about 15% and about 35%. Surprisingly, retention rates of noncationic surfactant applied to wet webs are high even though the surfactant is applied under conditions wherein it is not ionically substantive to the fibers. Retention rates in excess of about 90% are expected at the preferred fiber consistencies without the utilization of chemical retention aids.

As stated hereinbefore, it is also desirable to treat polysiloxane containing tissue paper with a relatively low level of a binder such as starch for lint control. Preferably, the tissue paper is treated with an aqueous solution of starch and, also preferably, the sheet is moist at the time of application. In addition to reducing linting of the finished tissue paper product, low levels of starch also imparts a modest improvement in the tensile strength of tissue paper without imparting boardiness (i.e., stiffness) which would result from additions of high levels of starch. Also, this provides tissue paper having improved strength/softness relationship compared to tissue paper which has been strengthened by traditional methods of increasing tensile strength: for example, sheets having increased tensile strength due to increased refining of the pulp; or through the addition of other dry strength additives. This result is especially surprising since starch has traditionally been used to build strength at the expense of softness in applications wherein softness is not an important characteristic: for example, paperboard. Additionally, parenthetically, starch has been used as a filler for printing and writing paper to improve surface printability.

In general suitable starch for practicing the present invention is characterized by water solubility, and hydrophilicity. Exemplary starch materials include corn starch and potato starch, albeit it is not intended to thereby limit the scope of suitable starch materials; and waxy corn starch that is known industrially as amioca starch is particularly preferred. Amioca starch differs from common corn starch in that it is entirely amylopectin, whereas common corn starch contains both amplopectin and amylose. Various unique characteristics of amioca starch are further described in "Amioca—The Starch From Waxy Corn", H. H. Schopmeyer, Food Industries, December, 1945, pp. 106–108 (Vol. pp. 1476–1478).

The starch can be in granular or dispersed form albeit granular form is preferred. The starch is preferably sufficiently cooked to induce swelling of the granules. More preferably, the starch granules are swollen, as by cooking, to a point just prior to dispersion of the starch granule. Such highly swollen starch granules shall be referred to as being "fully cooked". The conditions for dispersion in general can vary depending upon the size of the starch granules, the degree of crystallinity of the granules, and the amount of amylose present. Fully cooked amioca starch, for example, can be prepared by heating an aqueous slurry of about 4% consistency of starch granules at about 190° F. (about 88° C.) for between about 30 and about 40 minutes.

Other exemplary starch materials which may be used include modified cationic starches such as those modified to have nitrogen containing groups such as amino groups and methylol groups attached to nitrogen, available from National Starch and Chemical Company, (Bridgewater, N.J.). Such modified starch materials have heretofore been used primarily as a pulp furnish additive to increase wet and/or dry strength. However when applied in accordance with this invention by application to a wet tissue paper web they may have reduced effect on wet strength relative to wet-end addition of the same modified starch materials. Considering that such modified starch materials are more expensive than unmodified starches, the latter have generally been preferred.

The starch should be applied to the tissue paper while the paper is in a moist condition. The starch based material is added to the tissue paper web, preferably when the web has a fiber consistency of about 80% or less. Non-cationic starch materials are sufficiently retained in the web to provide an observable effect on softness at a particular strength level relative to increased refining; and, are preferably applied to wet tissue webs having fiber consistencies between about 15% and about 80%.

Starch is preferably applied to tissue paper webs in an aqueous solution. Methods of application include, the same previously described with reference to application of polysiloxane: preferably by spraying; and, less preferably, by printing. The starch may be applied to the tissue paper web simultaneously with, prior to, or subsequent to the addition of polysiloxane and/or surfactant.

At least an effective amount of starch to provide lint control and concomitant strength increase upon drying relative to a non-starch treated but otherwise identical sheet is preferably applied to the sheet. Preferably, between about 0.01% and about 2.0% of starch is retained in the dried sheet, calculated on a dry fiber weight basis; and, more preferably, between about 0.2% and about 1.0% of starch-based material is retained.

Analysis of the amounts of treatment chemicals herein retained on tissue paper webs can be performed by any method accepted in the applicable art. For example, the level of polysiloxane retained by the tissue paper can be determined by solvent extraction of the polysiloxane with an organic solvent followed by atomic absorption spectroscopy to determine the level of silicon in the extract; the level of nonionic surfactants, such as alkylglycosides, can be determined by extraction in an organic solvent followed by gas chromatography to determine the level of surfactant in the extract; the level of anionic surfactants, such as linear alkyl sulfonates, can be determined by water extraction followed by colorimetry analysis of the extract; the level of starch can be determined by amylase digestion of the starch to glucose followed by colorimetry analysis to determine glucose level. These methods are exemplary, and are not meant to exclude other methods which may be useful for determining levels of particular components retained by the tissue paper.

Hydrophilicity of tissue paper refers, in general, to the propensity of the tissue paper to be wetted with water. Hydrophilicity of tissue paper may be somewhat quantified by determining the period of time required for dry tissue paper to become completely wetted with water. This period of time is referred to as "wetting time." In order to provide a consistent and repeatable test for wetting time, the following procedure may be used for wetting time determinations: first, a dry (greater than 90% fiber consistency level) sample unit sheet, approximately $4\frac{3}{8}$ inch$\times 4\frac{3}{4}$ inch (about 11.1 cm$\times$12 cm) of tissue paper structure is provided; second, the sheet is folded into four (4) juxtaposed quarters, and then crumpled into a ball approximately 0.75 inches (about 1.9 cm) to about 1 inch (about 2.5 cm) in diameter; third, the balled sheet is placed on the surface of a body of distilled water at 72° F. (about 22° C.), and a timer is simultaneously started; fourth, the timer is stopped and read when wetting of the balled sheet is completed. Complete wetting is observed visually.

The preferred hydrophilicity of tissue paper depends upon its intended end use. It is desirable for tissue paper used in a variety of applications, e.g., toilet paper, to completely wet in a relatively short period of time to prevent clogging once the toilet is flushed. Preferably, wetting time is 2 minutes or less. More preferably, wetting time is 30 seconds or less. Most preferably, wetting time is 10 seconds or less.

Hydrophilicity characters of tissue paper embodiments of the present invention may, of course, be determined immediately after manufacture. However, substantial increases in hydrophobicity may occur during the first two weeks after the tissue paper is made. i.e., after the paper has aged two (2) weeks following its manufacture. Thus, the above stated wetting times are preferably measured at the end of such two week period Accordingly, wetting times measured at the end of a two week aging period at room temperature are referred to as "two week wetting times."

The density of tissue paper, as that term is used herein, is the average density calculated as the basis weight of that paper divided by the caliper, with the appropriate unit conversions incorporated therein. Caliper of the tissue paper, as used herein, is the thickness of the paper when subjected to a compressive load of 95 g/in$^2$ (15.5 g/cm$^2$).

What is claimed is:

1. Tissue paper having a basis weight of from about 10 to about 65 grams per square meter, and density of about 0.6 grams or less per cubic centimeter, said tissue paper comprising cellulosic fibers and an effective amount of a polysiloxane material, said polysiloxane being uniformly disposed on the outwardly facing surfaces of the tissue paper, said effective amount of polysiloxane being from about 0.004% to about 2% polysiloxane based on the dry fiber weight of said tissue paper, said polysiloxane having a viscosity of about 25 centistokes or more, said tissue paper after aging two weeks after its manufacture has a wetting time of 2 minutes or less.

2. The tissue paper of claim 1 wherein said effective amount of polysiloxane is from about 0.004% to about 0.3% polysiloxane based on the dry fiber weight of said tissue paper.

3. The tissue paper of claim 1 wherein said polysiloxane is polydimethylpolysiloxane having a hydrogen bonding functional group selected from the groups consisting of amino, carboxyl, hydroxyl, ether, polyether, aldehyde, ketone, amide, ester, and thiol groups, said hydrogen bonding functional group being present in a molar percentage of substitution of about 20% or less.

4. The tissue paper of claim 3, wherein said polysiloxane has a molar percentage of substitution of about 10% or less, and a viscosity of from about 25 centistokes to about 20,000,000 centistokes.

5. The tissue paper of claim 3 wherein said polysiloxane has a molar percentage of substitution of from about 1.0 to about 5%, and a viscosity of from about 25 centistokes to about 20,000,000 centistokes.

6. The tissue paper of claim 3 wherein said molar percentage of substitution is about 2%, and said viscosity is about 125 centistokes.

7. The tissue paper of claim 1 further comprising a sufficient quantity of a surfactant material to ensure that said tissue paper, after aging two weeks after its manufacture, has a wetting time of about 30 seconds or less.

8. The tissue paper of claim 7 wherein said quantity of said surfactant is sufficient to ensure that two-week-aged said tissue paper has a wetting time of about 10 seconds or less.

9. The tissue paper of claim 1 further comprising a quantity of surfactant material, said quantity being between about 0.01% and about 2% based on the dry fiber weight of said tissue paper.

10. The tissue paper of claim 9 wherein said quantity of said surfactant is from about 0.05% to about 0.5% based on the dry fiber weight of said tissue paper.

11. The tissue paper of claim 7 or 10 wherein said surfactant material is noncationic.

12. The tissue paper of claim 9 or 11 wherein said surfactant has a melting point of at least about 50° C.

13. The tissue paper of claim 1 further comprising an effective measure of a binder material to at least partially offset any reduction of tensile strength or increase in linting propensity of said tissue paper which would otherwise result from he incorporation of said polysiloxane.

14. The tissue paper of claim 13 wherein said binder material is starch.

15. The tissue paper of claim 14 wherein said effective measure of said starch is between about 0.01% and about 2% based on the dry fiber weight of said tissue paper.

16. The tissue paper of claim 2 further comprising a quantity of a surfactant, said quantity being between about 0.01% and about 0.5% based on the dry fiber weight of said tissue paper.

17. The tissue paper of claim 16 further comprising an effective measure of a binder material to at least partially offset any reduction of tensile strength or increase in linting propensity of said tissue paper which would otherwise result from the incorporation of said polysiloxane and said surfactant.

18. The tissue paper of claim 17 wherein said binder material is starch.

19. The tissue paper of claim 8 wherein said effective measure of said starch is between about 0.01% and about 2% based on the dry fiber weight of said tissue paper.

* * * * *